US005407592A

United States Patent [19]

Cheng et al.

[11] Patent Number: 5,407,592

[45] Date of Patent: Apr. 18, 1995

[54] MULTIFUNCTIONAL ADDITIVES

[75] Inventors: Vic M. Cheng, Sewell; Liehpao O. Farng, Lawrenceville; Andrew G. Horodysky, Cherry Hill; Ronald J. Poole, Mullica Hills, all of N.J.

[73] Assignee: Mobil Oil Corporation, Fairfax, Va.

[21] Appl. No.: 947,609

[22] Filed: Sep. 21, 1992

Related U.S. Application Data

[63] Continuation-in-part of Ser. No. 735,125, Jul. 23, 1991, abandoned.

[51] Int. Cl.[6] ..... C10M 133/44

[52] U.S. Cl. ..... 252/51.5 R; 44/343; 548/260

[58] Field of Search ..... 252/50, 51.5 R; 44/343; 548/257; 2/260, 269.4

[56] References Cited

U.S. PATENT DOCUMENTS

| | | | |
|---|---|---|---|
| 3,413,227 | 11/1968 | Howard et al. | 252/51.5 A |
| 4,519,928 | 5/1985 | Broid | 548/257 |
| 4,626,368 | 12/1986 | Cardis | 548/257 |
| 4,701,273 | 10/1987 | Brady et al. | 548/257 |
| 5,076,946 | 12/1991 | Frankenfold et al. | 548/257 |

*Primary Examiner*—Margaret Medley
*Attorney, Agent, or Firm*—Alexander J. McKillop; Malcolm D. Keen; Jessica M. Sinnott

[57] ABSTRACT

A lubricant of fuel composition contains a multifunctional antioxidant/metal deactivating and thermal stabilizing amount of a tolyltriazole-derived Mannich base made from a tolyltriazole, an aliphatic amine, such as diisobutylamine or bis(2-ethylhexyl)amine, a cyclic amine, such as 1,4-diaminocyclohexane or ether amines exemplified by $C_6$ to $C_{13}$ alkoxypropylamines and polyether primary amines such as those derived from nonylphenol ethyoxylates and formaldehyde. The reaction products are, optionally, treated with epoxide.

7 Claims, No Drawings

MULTIFUNCTIONAL ADDITIVES

This is a continuation-in-part application of U.S. application Ser. No. 07/735,125, filed on Jul. 23, 1991, now abandoned, and which is incorporated herein by reference in its entirety.

FIELD OF THE INVENTION

The invention relates to lubricants and fuel compositions. Particularly the invention relates to lubricant and fuel additives which have antioxidant and metal deactivating activity, good thermal stability and improved compatibility in mineral and synthetic lubricant compositions.

BACKGROUND OF THE INVENTION

Although base oils posses some aging stability and resistance to oxidation which is sufficient for normal demands, high load and temperature conditions, which are particularly found in internal combustion engines and gears, tend to increase the internal degradation of the lubricant. Metals reaching the lubricant by surface abrasion, acidic oxidation products and fuel combustion products mix with the lubricant and lead to premature aging of the lubricant. In an internal combustion engine, premature lubricant aging can lead to deposit formation on the Distorts which leads to ring sticking and eventual destruction of the engine. Increased acidity from oxidation products causes metal corrosion. Dissolved metals form salts which together with other aging products form sludge deposits which can block the filters and oil ducts and cause serious malfunction of the engine. The increase in viscosity which is caused by oxidation of gear oils can cause damage to the gear teeth and seizure due to reduced load-carrying capacity. Certain known metal deactivators or chelating agents include aromatic amines such as, dialkyldiphenylamines, heterocyclic amines, such as, imidazole, pyrazole, aminomercaptothiadiazole and dimercaptothiadiazole. The problem with these compounds, however, is that they are difficult to work with in lubricant blending operations because their bulkiness, polarity and reactivity makes them insoluble in most organic media.

SUMMARY OF THE INVENTION

The instant invention is directed to additives which are soluble in most base stocks. An additive has been discovered which has antioxidant, metal deactivating and thermal stability properties when incorporated into lubricating oils and fuels comprising the reaction product of an aldehyde or ketone, an alkylaryl triazole and an amine selected from the group consisting of an alkylamine, aliphatic diamine, alicyclic amine, heterocyclic amine and aliphatic etheramine. The synergism between the triazole metal deactivator and the amine antioxidant creates a very effective multipurpose additive which is soluble in lubricants because of the alkyl group of the triazole.

The alkylaryltriazole is a 5-membered ring structure in which three of the ring members are nitrogen, the other ring members can be oxygen, sulfur or carbon atoms. Typical triazoles contemplated are those already known for their antioxidant characteristics. The triazole is characterized by the following structural formula:

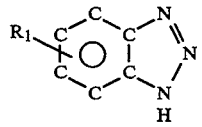

where $R_1$ is an alkyl group containing 1 to 60 carbon atoms or an alkyl group containing 2 to 60 carbon atoms and at least one heteroatom which is oxygen, sulfur or nitrogen. Representative examples of alkyl groups include methyl, ethyl, propyl, butyl, pentyl, hexyl, heptyl, octyl, nonyl, decyl and dodecyl or any combination thereof. Non-limiting examples of suitable triazoles include tolyltriazole where $R_1$ is methyl, propylbenzotriazole, butylbenzotriazole, the higher benzotriazoles such as dodecylbenzotriazole and oxygenated benzotriazoles such as carboxymethylbenzotriazole. The triazoles are known in the art and can be obtained from commercial sources.

The carbonyl compound can be any compound containing the group (C=O) which occurs in aldehydes and ketones. This compound can be characterized by the structural formula

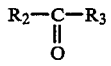

in which $R_2$ and $R_3$ are hydrogens or hydrocarbyl containing 1 to 60 carbon atoms which are alkyl, aryl, arylalkyl or alkylaryl. The hydrocarbyl group can also contain 2 to 60 carbon atoms and at least one heteroatom which can be oxygen, sulfur or nitrogen. Typical compounds which are not limited to the following examples include formaldehyde, heptaldehyde, hexaldehyde, acetaldehyde, propionaldehyde, paraformaldehyde, benzaldehyde, salicylaldehyde, acetone, diethyl ketone, methyl ethyl ketone and 2-ethylhexanal. These compounds are known in the art and are readily available from commercial sources or are easily made using known methods.

The alkylaryl triazole and the carbonyl compound are reacted with an aliphatic primary or secondary amine which can be an alkylamine, alicyclic amine, heterocyclic amine aliphatic etheramine or aliphatic diamine. The amines are characterized by at least one reactive hydrogen which is necessary for the reaction.

The alkylamines are primary or secondary amines designated by the structural formula:

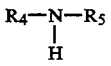

in which $R_4$ or $R_5$ is, independently, a hydrogen atom, in the case of a primary amine, or $R_4$ and $R_5$ are the same or different aliphatic hydrocarbon groups. $R_4$ or $R_5$ is a hydrocarbon group containing 1 to 60 carbon atoms and can contain at least one heteroatom which is oxygen, sulfur or nitrogen and 2 to 60 carbon atoms. The hydrocarbon group is paraffinic or olefinic containing at least one to 30 at most 50 to 60 carbon atoms. Non-limiting examples of the aliphatic primary or secondary amines include the straight chain monoamines such as methyethylamine, proplylamine or butylamine. The particularly preferred amines are the long-chain aliphatic amines such as pentylamine, hexylamine, octylamine, dioctylamine, dicocoamine, dioleylamine and the like. The term "long chain" designates the amines containing hydrocarbyl groups of $C_5$ and higher, preferably over $C_8$ and in the range of $C_5$ to $C_{22}$, preferably $C_8$ to $C_{20}$. The branched chain aliphatic amines include, but are not limited to the short chain amines, i.e., isopropylamine, isobutylamine, diisobutylamine and longer chain branched amines such as bis(2-ethylhexyl-)amine. The term "short chain amines" designates amines containing hydrocarbon groups of $C_5$ and lower, preferably $C_3$ and lower.

The aliphatic diamines are also used. In general the long-chain diamines are contemplated and have the structural formula:

$$R_6-\overset{\overset{\displaystyle H}{|}}{N}-R_7-NH_2$$

where $R_6$ is an alkylene group containing 10 to 30 carbon atoms and $R_7$ is an alkylene group containing 2 to 4 carbon atoms. Some nonlimiting examples of diamines include N-tallow-1,3-propylenediamine, N-oleyl-1,3-propylenediamine, N-linoleyl-1,3-propylenediamine, N-stearyl-1,3-propylenediamine, N-soya-1,3-propylenediamine, N-cocoyl-1,3-diaminopropane, and mixtures of two or more of these amines.

Non-limiting examples of the alicyclic amines are dicyclohexylamine, 1,4-diaminocyclohexane, piperidine and hexamethyleneimine.

The contemplated amines are also heterocyclic in which the nitrogen atom is an integral member of a ring structure which is predominantly composed of carbon atoms. Most suitable, but not limiting examples of heterocyclic amines include morpholine, aminopropylmorpholine (APM) and aminoethylpiperazine (AEP).

The oxygenated amines are also suitable. The oxygenated amines contemplated are the aliphatic etheramines such as the alkoxypropylamines having the structural formula $$R_8-O\leftarrow C_3H_6\rightarrow NH_2$$

in which $R_8$ is an alkyl group which contains 4 to 20, preferably 6 to 18 carbon atoms. Nonlimiting examples of the alkoxypropylamines include 3-methoxypropylamine, 3-ethoxypropylamine, 3-propyloxypropylamine, 3-butyloxypropylamine, 3-octyloxypropylamine, 3-hexoxypropylamine, 3-heptoxypropylamine, 3-nonyloxypropylamine and 3-decyloxypropylamine.

The etherdiamines are another class of oxygenated amines which are suitable. Nonlimiting examples of the etherdiamines are those having the structure:

$$R_8-O-R_9-\overset{\overset{\displaystyle H}{|}}{N}-R_{11}-NH_2$$

Where $R_8$ is as defined above, but preferably contains 6 to 18 carbon atoms arranged in a straight or branched chain configuration. $R_9$ is an alkyl group containing 2 to 4 carbon atoms, $R_{11}$ is an alkyl group having at least 2 to 3 carbon atoms, at most 5 to 10 carbon atoms. Nonlimiting examples of etherdiamines include hexoxypropyl-1,3-propylenediamine, heptoxypropyl-1,3-propylenediamine, octoxypropyl-1,3-propylenediamine and nonoxypropyl-1,3-propylenediamine and any mixtures of the foregoing etherdiamines.

The polyether primary amines are also contemplated. Suitable polyether primary amines have the following structural formula $$R_{10}-O(C_2H_3(R_{11})O)_nC_3H_6NH_2$$

where $R_{10}$ is an alkyl-substituted phenyl group containing 14 to 26 carbon atoms, $C_6$ to $C_{30}$ alkyl group or $C_7$ to $C_{30}$ aralkyl group, n is an integer ranging from 2 to 10 and $R_{11}$ is independently hydrogen or methyl. These alkyl-substituted phenol-derived polyetheramines are sold by Texaco Chemical Co. under the trademark Surfonamine. Those available commercially include:

| Trademark | Structure |
|---|---|
| Surfonamine MNPA-380 | nonylphenyl-1EO-2PO-$NH_2$ |
| Surfonamine MNPA-510 | nonylphenyl-4EO-2PO-$NH_2$ |
| Surfonamine MNPA-750 | nonylphenyl-9.5EO-2PO-$NH_2$ |
| Surfonamine MNPA-860 | nonylphenyl-12EO-2PO-$NH_2$ |

Contemplated polyether primary amines are those derived from nonylphenol ethoxylates such as where $R_{10}$ is nonylphenyl. Specific examples of these polyether primary amines include the compounds sold by Texaco under the tradename SURFONAMINE MNPA.

The triazole, the carbonyl compound and the amine can be reacted together in any sequence. However, for illustrative purposes, the amine is added to a solvated mixture of the triazole and the carbonyl compound. The triazole and the carbonyl compound are reacted in an equimolar proportion such that one equivalent amount of the carbonyl compound is used for each equivalent amount of the triazole and the amine. The reaction is a condensation reaction in which water is formed as the product evolves. The amount of water produced by the reaction is used to monitor the course of reaction: one mole of water being formed for each mole of product formed.

For illustrative purposes, it is believed that the following reaction occurs when the reactants are combined:

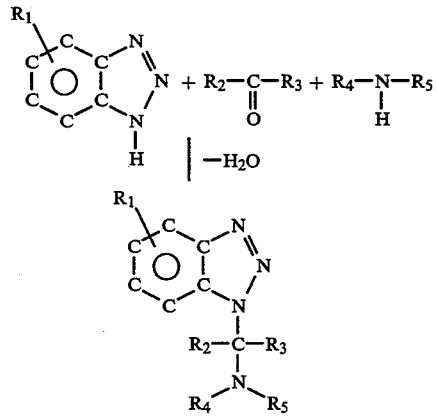

where $R_1$, $R_2$, $R_3$, $R_4$ are described above.

The reaction is carried out at a temperature of less than 50° C., preferably less than 40° C., which increases to at least 60° C. to 70° C., at most 110° C. to 150° C. during the course of the reaction. After the reactants have been contacted for at least 10 minutes to 1 hour, at most 3 hours to 8 hours, any solvent used to facilitate the reaction and any water present which is produced by the reaction is removed, usually by azeotropic and/or vacuum distillation. A solvent or diluent inert to the reactants :can be used to facilitate the reaction and which provide good solubility for the triazole. Nonlimiting examples of suitable solvents include methanol, ethanol, isopropyl alcohol, butanol and other similar alcohols.

The reaction product is, optionally, treated with an epoxide to further enhance the solubility and stability of the product. The epoxide treatment converts any secondary amines to tertiary amines and creates a pendant hydroxy group which lends improved stability and solubility to the product. The pendant hydroxy groups also produce a site for further reaction with functionalizing compounds. The epoxide is generally added in stoichiometrically equivalent amounts such that one equivalent amount is added for each equivalent amount of the amine. Suitable epoxides include ethylene oxide, propylene oxide, butylene oxide, pentylene oxide, hexylene oxide and higher alkylene oxides, isomers, polymers and copolymers thereof.

The reaction products are blended with lubricants in a concentration of about 0.01% to 10%, preferably, from 0.05% to 5% by weight of the total composition.

As previously mentioned, the additives are suitable for use in engine oils and gear oils. The engine oils which will benefit from these additives include oils for gasoline burning engines and diesel engines. The contemplated gear oils which will benefit from the additives are hypoid gear oils which are exposed to the most severe service conditions. Other gear oils contemplated include automotive spiral-bevel and worm gear axle oils.

Although the additives are successful in internal combustion engine oils and gear oils, it is contemplated that the additives will successfully perform in other functional fluids and industrial lubricants. Other lubricant applications contemplated include the use of the instant additives in circulation oils and steam turbine oils, gas turbine oils (both heavy-duty gas turbines and aircraft gas turbines), machine tool lubricants and hydraulic fluids.

The contemplated lubricants are liquid oils in the form of either a mineral oil or synthetic oil or mixtures thereof. Also contemplated are greases in which any of the foregoing oils are employed as a base. Still further materials which it is believed would benefit from the reaction products of the present invention are fuels and plastic materials.

In general, the mineral oils, both paraffinic and naphthenic and mixtures thereof can be employed as a lubricating oil or as the grease vehicle. The lubricating oils can be of any suitable lubrication viscosity range, for example, from about 45 SSU at 100° F. to about 6000 SSU at 100° F., and preferably from about 50 to 250 SSU at 210° F. Viscosity indexes range from about 70 and higher, preferably 90 to 130. The average molecular weights of these oils can range from about 250 to about 800.

It is also desirable to employ the additive in greases. The additive is particularly useful when used in gear greases. However, other classes of greases which will benefit from the additive include greases for automobile chassis lubrication, greases for journal and wheel bearings, etc. Typically, the range of application includes the automotive industry, railways and aviation industries.

Where the lubricant is employed as a grease, the lubricant is generally used in an amount sufficient to balance the total grease composition, after accounting for the desired quantity of the thickening agent, and other additive components included in the grease formulation. A wide variety of materials can be employed as thickening or gelling agents. These can include any of the conventional metal salts or soaps, such as calcium, or lithium stearates or hydroxystearates, which are dispersed in the lubricating vehicle in grease-forming quantities in an amount sufficient to impart to the resulting grease composition the desired consistency. Other thickening agents that can be employed in the grease formulation comprise the non-soap thickeners, such as surface-modified clays and silicas, aryl ureas, calcium complexes and similar materials. In general, grease thickeners can be employed which do not melt or dissolve when used at the required temperature within a particular environment; however, in all other respects, any material which is normally employed for thickening or gelling hydrocarbon fluids for forming greases can be used in the present invention.

Where synthetic oils, or synthetic oils employed as the vehicle for the grease are desired in preference to mineral oils, or in mixtures of mineral and synthetic oils, various synthetic oils may be used. Typical synthetic oils include the polyalphaolefins, polypropylene glycol, polyethylene glycol, trimethylol propane esters, neopentyl and pentaerythritol esters, di(2-ethylhexyl) sebacate, di(2-ethylhexyl) adipate, dibutyl phthalate, silicate esters silanes, esters of phosphorus-containing acids, hydrogenated synthetic oils, chain-type polyphenyls, siloxanes and silicones (polysiloxanes) and alkyl-substituted diphenyl ethers typified by a butyl-substituted bis(p-phenoxy phenyl) ether and phenoxy phenylethers.

The lubricating oils and greases contemplated for blending with the reaction product can also contain other additives generally employed in lubricating compositions such as corrosion inhibitors, detergents, extreme pressure agents, viscosity index improvers, friction reducers, antiwear agents and the like. Typical examples of these additives include but are not limited to phenates, sulfonates, imides, heterocyclic compounds, polymeric acrylates, amines, amides, esters, sulfurized olefins, succinimides, succinate esters, metallic detergents such as those containing calcium or magnesium, arylamines, hindered phenols and the like.

It is also contemplated that the additives are useful in fuels, the fuels contemplated are liquid hydrocarbon and liquid oxygenated fuels such as alcohols and ethers. The additives can be blended in a concentration from about 25 to about 500 pounds of additive per 1000 barrels of fuel. Liquid hydrocarbon fuels include gasoline, fuel oils, diesel oils and alcohol fuels which include methyl and ethyl alcohols and ethers such as diisopropyl ether and methyl-tert-butyl ether.

Specifically, the fuel compositions contemplated include gasoline base stocks such as a mixture of hydrocarbons boiling in the gasoline boiling range which is from about 90° F. to about 450° F. This base fuel may consist of straight chains or branched chains, paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point from about 75° F. to about 135° F. and an end boiling point from about 250° F. to about 750° F. It should be noted in this respect that the term distillate fuels is not intended to be restricted to straight-run distillate fractions. These distillate fuel oils can be straight-run distillate fuel oils, alkylate, catalytically or thermally cracked (including hydrocracked) distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as Diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. Typical of such fuels are methanol, ethanol and mixtures of methanol and ethanol. The fuels which may be treated with the additive include gasohols which my be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

EXAMPLES

Example 1

Tolyltriazole-Formaldehyde-Bis(2-ethlyhexyl)amine

Approximately 40.0 gm (0.3 mole) of tolyltriazole (commercially obtained from PMC Specialties Group, Inc. under the tradename Cobratec TT-100), 25.1 gm (0.31 mole) aqueous formaldehyde (37 wt. % solution in water), and 50 ml of methanol were charged into a 500 ml reactor equipped with a reflux condenser, thermometer, dropping funnel, and mechanical stirrer. The reaction mixture became homogeneous after stirring for about 5 minutes. Then 72.5 gm (0.3 mole) of bis(2-ethylhexyl)amine was slowly added to the reactor at a temperature less than 40° C. (moderate exotherm is observable). Thereafter, the mixture was heated to ~70° C. and maintained at reflux for 3 hrs. Then the reactants were heated at 110° C. during which methanol and water was azeotropically collected in the Dean-Stark trap. Finally, house vacuum was used to remove the trace amount of water at 110° C. for a half hour. A final filtration to remove possible unreacted tolyltriazole is optional. Small amounts of residual water could make the final product appear hazy. Approximately 115.3 gm of yellow liquid was recovered as desired product (>99% yield).

Example 2

Tolyltriazole-Formaldehyde-Diisobutylamine

Approximately 80.1 gm (0.6 mole) of tolyltriazole, 200 ml 2-propanol, and 78.0 gm (0.6 mole) diisobutylamine were mixed in a 500 ml reactor until a homogeneous phase was formed. 51.0 gm (0.618 mole) of aqueous formaldehyde was slowly added while maintaining a reactor temperature ≦40° C. Thereafter, the reactants were heated at 82±2° C. for 4 hrs., then at 110±2° C. for two additional hours during which isopropanol and water were removed by distillation. The final product (163.5 gm) is a yellowish liquid which solidifies upon standing at ambient temperature (m.p. 49°–51° C.). A final filtration to remove possibly unreacted tolyltriazole is optional. However, small amounts of residual water could make the final product appear hazy.

Example 3

The procedure of Example 1 was followed with only one exception: equimolar commercial arylalkyl etheramine surfonamine MNPA 380 was used instead of bis(2-ethylhexyl)amine.

Example 4

The procedure of Example 1 was followed with only one exception: equimolar dibutylamine was used instead of bis (2-ethylhexyl)amine.

Example 5

The procedure of Example 1 was followed with only one exception: equimolar dicyclohexylamine was used instead of bis (2-ethylhexyl)amine.

Example 6

The procedure of Example 1 was followed with only one exception: equimolar dipentylamine was used instead of bis(2-ethylhexyl)amine.

Example 7

The procedure of Example 1 was followed with only one exception: equimolar Exxon Etheramine PA-14 was used instead of bis(2-ethylhexyl)amine.

Example 8

The procedure of Example 1 was followed with only one exception: equimolar 2-ethyl-1-hexylamine was used instead of bis(2-ethylhexyl)amine.

Example 9

The procedure of Example 1 was followed with only one exception: equimolar hexamethylene imine was used instead of bis(2-ethylhexyl)amine.

Example 10

The procedure of Example 1 was followed with only one exception: equimolar N-aminoethyl piperazine was used instead of bis(2-ethylhexyl)amine.

Example 11

The procedure of Example 1 was followed with only one exception: equimolar 4-(3-aminopropyl)morpholine was used instead of bis(2-ethylhexyl)amine.

Example 12

The procedure of Example 1 was followed with only one exception: equimolar morpholine was used instead of bis(2-ethylhexyl)amine.

Example 13

The procedure of Example 1 was followed with only one exception: equimolar diisobutylamine was used instead of bis(2-ethylhexyl)amine.

Example 14

The procedure of Example 1 was followed with one exception: equimolar 1,4-diaminocyclohexane was used instead of bis(2-ethylhexyl)amine.

Example 15

The procedure of Example 1 was followed with one exception: one half molar Exxon etherdiamine DA-14 was used instead of bis(2-ethylhexyl)amine.

Example 16

The procedure of Example 1 was followed with one exception: one half molar Exxon etherdiamine DA-17 was used instead of bis(2-ethylhexyl)amine.

Example 17

The procedure of Example 1 was followed with the following exceptions: N-oleyl-1,3-diaminopropane (Akzo Duomeen O) was used instead of bis(2-ethylhexyl)amine, and only one half molar Duomeen O was employed for this reaction.

Example 18

The procedure of Example 17 was followed with one exception: equimolar N-cocoyl-1,3-diaminopropane (Akzo Duomeen C) was used instead of N-oleyl-1,3-diaminopropane.

Example 19

The procedure of Example 18 was followed with one additional subsequent reaction: the reaction adduct of Example 18 was further treated with equimolar 1,2-epoxide propane.

EVALUATION OF THE PRODUCT

A significant feature of the additives is that they impart enhanced thermal stability and oxidation and corrosion inhibition to the fluid compositions into which they are incorporated. The ability of the products of the examples to withstand severe performance conditions was tested in the CMCo Heat Test (the test data were reported in Table 1) and the Pressure Differential Calorimetry Test (PDSC) for oxidation (the test data were reported in Table 2).

In the CMCo Heat Test procedure, a thermal stability test, clean, polished, preweighed copper and steel rods were placed in a 250 ml Griffin beaker containing 200 cc of the lubricant sample to be tested. The beaker and its contents were placed in an aluminum fixture in an electric gravity convection oven which maintained the temperature was maintained at 375° C. for about one week. After about one week, the samples were removed and allowed to cool to room temperature. The copper rod was removed from the oil sample, washed with acetone to remove all oil and dried. The dry, clean rod was weighed and its condition was visually evaluated for any signs of corrosion. The copper rod was then placed in a solution of potassium cyanide (KCN) at room temperature until all visible deposits were removed. The rod was then washed with distilled water followed by an acetone wash and air dried. The rod was then weighed to the nearest 0.1 mg. The steel rod was removed from the sample washed with naphtha and air dried. The rod was weighed and visually evaluated for discoloration.. The rod was then placed in a 20% solution of sodium hydroxide (NaOH) and any softened lacquer was wiped away. The rod was then washed with acetone, dried and weighed to the nearest 0.1 mg. A visual comparison between the test copper and steel rods and a reference set of copper and steel rods was made. The reference set was rated on a scale of 1 to 9, depending upon the degree of discoloration .and corrosion. A score of 9 was given to the most severely corroded reference rod. A score of 1 was given to the cleanest reference rod which was essentially free of any signs of deterioration. The reference rods which fell within the lower range of this scale were acceptable even though slightly discolored or slightly to moderately tarnished and were rated from 3–5. The reference rods which fell within the upper range of the scale were unacceptably discolored or corroded and were rated from 6–8. The test rods were compared with the reference rods and were rated based on their degree of corrosion relative to the reference set. All of the products of the examples achieved acceptable copper rod ratings under the vigorous, severely corrosive conditions of the test. The base oil containing a conventional additive package, but without the additive of the present invention, obtained a rating of 9 indicating a high corrosivity to copper. As shown in Table 1, adding a small amount of the present additive to the base oil composition remarkably elevated the copper and steel rod ratings.

TABLE 1

| CMCo Heat Test (one week, 375°) | | | |
|---|---|---|---|
| Item | Conc. wt % | Copper Rod Rating | Steel Rod Rating |
| Base oil (a formulated mineral oil containing defoamant/demulsifier/antioxidant/antiwear/dispersant performance package) | — | 9 | 1 |
| Example 1 | 0.03 | 3 | 1 |
| (in above base oil) | 0.10 | 3 | 1 |
| Example 2 | 0.03 | 3 | 1 |
| (in above base oil) | 0.10 | 3 | 1 |
| Example 3 (in above base oil) | 0.03 | 3 | 1 |
| Example 4 (in above base oil) | 0.10 | 3 | 1 |
| Example 8 (in above base oil) | 0.10 | 3 | 1 |
| Example 17 (in above base oil) | 0.10 | 4 | 1 |
| Example 18 (in above base oil) | 0.10 | 4 | 1 |
| Example 19 (in above base oil) | 0.10 | 4 | 1 |

In the Pressure Differential Calorimetry test (PDSC) for oxidation inhibition, the thermal stability of the lubricant containing the additive of the present invention was measured. The results of tile test were reported in Table 2. In the PDSC test, the test instrument measured the oxidation onset temperature: the temperature at which the lubricating oil started to degrade (oxidize). The onset temperature was measured by gradually increasing the temperature at a specified rate over a certain temperature range. The higher the onset temperature, the more thermally stable the lubricant and the better the lubricating oil was at resisting oxidative change. A more detailed description of the PDSC procedure will be found in "Characterization of Lubricating Oils by Differential Scanning Colorimetry," Walker et al., SAE Technical Paper Series No. 803,383, 1980 and "Characterization of Lube Oils and Fuel Oils by DSC Analysis, F. Noel, Journal of the Institute of Petroleum, Vol. 57, No. 568, November 1971, pp 354–358, which are both incorporated herein by reference.

The data show that a small 0.1% concentration of the additive can raise the onset temperature of the base oil sample T(° C.) up to 13.8° C.

TABLE 2

PDSC Oxidation Test (500 psi oxygen pressure, ramp 10° C./minute from 30° C. to 275° C.)

| Item | Concentration | Onset Temp. | T (°C.) |
|---|---|---|---|
| Base oil (200 sec solvent refined paraffinic neutral mineral oil | — | 216.1 | — |
| Example 2 (in above base oil) | 0.1% | 228.5 | +12.4 |
| Example 3 (in above base oil) | 0.1% | 229.9 | +13.8 |
| Example 16 (in above base oil) | 0.1% | 222.4 | +6.3 |
| Example 18 (in above base oil) | 0.1% | 227.5 | +11.4 |
| Example 19 (in above base oil) | 0.1% | 227.4 | +11.3 |

As can be seen from the above test results, the products of the invention exhibited considerable corrosion inhibiting activity, antioxidation characteristics and thermal stability in lubricating oils and greases.

What is claimed is:

1. A lubricant composition comprising a major amount of a normally liquid lubricant and a minor amount of a lubricant additive having antioxidant, high temperature solubility and thermal stability properties comprising a reaction product made by reacting, in equimolar proportions, an aldehyde; a benzotriazole which has the structural formula:

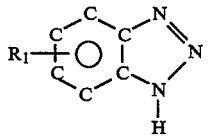

where $R_1$ is an alkyl group containing 1 to 60 carbon atoms or an alkyl group of 2 to 60 carbon atoms and containing at least one heteroatom which is oxygen, sulfur or nitrogen bonded to the alkyl group; and a polyether primary amine which has the structural formula $$R_{10}-O\left(C_2H_3-R_{11}-O\right)_n C_3H_6NH_2$$

where $R_{10}$ is an alkyl-substituted phenyl group containing 14 to 26 carbon atoms, n is an integer ranging from 2 to 10 and $R_{11}$ is independently hydrogen or methyl.

2. The lubricant composition of claim 1 in which the aldehyde is formaldehyde.

3. The lubricant composition of claim 1 in which the hydrocarbyl group designated as $R_1$ is methyl.

4. The lubricant composition of claim 1 in which the lubricant is a mineral oil or synthetic oil or a mixture thereof.

5. The lubricant composition of claim 4 in which the lubricant composition is a grease comprising the mineral or synthetic oil or mixture thereof and a thickening agent.

6. The lubricant composition of claim 1 in which the aldehyde is formaldehyde and the benzotriazole is tolyltriazole.

7. The lubricant composition of claim 1 in which the polyether primary amine is derived from nonylphenol ethoxylates.

* * * * *